US010274262B2

(12) United States Patent
Okubo et al.

(10) Patent No.: US 10,274,262 B2
(45) Date of Patent: Apr. 30, 2019

(54) HEAT EXCHANGER

(71) Applicant: T.RAD Co., Ltd., Tokyo (JP)

(72) Inventors: Atsushi Okubo, Tokyo (JP); Takuya Bungo, Tokyo (JP); Taiji Sakai, Tokyo (JP)

(73) Assignee: T.RAD CO., LTD., Tokyo (JP)

( * ) Notice: Subject to any disclaimer, the term of this patent is extended or adjusted under 35 U.S.C. 154(b) by 101 days.

(21) Appl. No.: 15/118,918

(22) PCT Filed: Feb. 12, 2015

(86) PCT No.: PCT/JP2015/054510
§ 371 (c)(1),
(2) Date: Aug. 15, 2016

(87) PCT Pub. No.: WO2015/122545
PCT Pub. Date: Aug. 20, 2015

(65) Prior Publication Data

US 2016/0370127 A1 Dec. 22, 2016

(30) Foreign Application Priority Data

Feb. 14, 2014 (JP) ..... 2014-027012

(51) Int. Cl.
*F28F 1/12* (2006.01)
*F28F 21/08* (2006.01)
(Continued)

(52) U.S. Cl.
CPC ..... *F28F 1/126* (2013.01); *F28D 1/05366* (2013.01); *F28F 9/001* (2013.01);
(Continued)

(58) Field of Classification Search
CPC ..... F28F 2265/26; F28F 1/126; F28F 9/001; F28F 21/084; F28F 2225/00; F28F 2225/02; F28F 2275/04; F28D 1/05366
See application file for complete search history.

(56) References Cited

U.S. PATENT DOCUMENTS 6,412,547 B1 * 7/2002 Siler ..... F28F 9/001 165/149
6,736,193 B2 * 5/2004 Kodumudi ..... F28F 9/001 165/149
(Continued)

FOREIGN PATENT DOCUMENTS

EP 1001241 A2 5/2000
JP 1-266488 A 10/1989
(Continued)

*Primary Examiner* — Tho V Duong
(74) *Attorney, Agent, or Firm* — Norris McLaughlin, P.A.

(57) ABSTRACT

In order to prevent deformation of a side member due to thermal stress in a heat exchanger in which water for cooling a high-temperature body circulates, a side member is formed in the shape of a groove, the cross section of which has side wall parts and a base part along the entire length in the lengthwise direction of a main body part, and both ends of the side member in the lengthwise direction are provided with a stepped part, which is formed as a step toward the outside of a core, and one or more brace-like ribs, which integrally connect the tip end and the base part of the stepped part in a slanting manner.

7 Claims, 7 Drawing Sheets

(51) Int. Cl.
*F28D 1/053* (2006.01)
*F28F 9/00* (2006.01)

(52) U.S. Cl.
CPC ..... *F28F 21/084* (2013.01); *F28F 2225/00* (2013.01); *F28F 2225/02* (2013.01); *F28F 2265/26* (2013.01); *F28F 2275/04* (2013.01)

(56) References Cited

U.S. PATENT DOCUMENTS

| | | | | |
|---|---|---|---|---|
| 8,800,642 | B2 * | 8/2014 | Ninagawa | F28F 9/0226 165/148 |
| 2005/0230089 | A1 * | 10/2005 | Ozaki | F28F 9/001 165/149 |
| 2007/0012424 | A1 | 1/2007 | Kamiya et al. | |
| 2012/0118543 | A1 | 5/2012 | Ninagawa et al. | |

FOREIGN PATENT DOCUMENTS

| | | | | | |
|---|---|---|---|---|---|
| JP | 01266488 | A | * | 10/1989 | F28D 1/0535 |
| JP | 05001895 | A | * | 1/1993 | F28F 9/001 |
| JP | 2003-035498 | A | | 2/2003 | |
| JP | 2008-014622 | A | | 1/2008 | |

* cited by examiner

HEAT EXCHANGER

BACKGROUND OF THE INVENTION

The present invention relates to a heat exchanger that prevents deformation due to thermal expansion of a core in operation in a radiator for automobile or the like.

As shown in FIG. 7, a heat exchanger for cooling engine cooling water includes flat tubes 1 and corrugated fins 2 alternately arranged in parallel with one another. Both ends of each of the flat tubes 1 are inserted into a pair of tube plates 4 to form a core 3. A not shown tank main body is mounted on the each tube plate 4, and side members 5 are disposed on both sides of the core 3.

The side member 5 includes side walls at its intermediate part in the lengthwise direction, having U-like cross section, but does not have side walls at both ends.

The cooling water at high temperature resulting from cooling the engine is guided from the tank main body at one side to the other tank main body through circulation in the each flat tube 1. An air blowing operation is carried out toward the outer surface side of the flat tube 1 and the corrugated fin 2 side for heat exchange between air and the high-temperature cooling water.

Circulation of the high-temperature cooling water in the flat tube 1 will extend the flat tube 1 and the corrugated fin 2 in the lengthwise direction of the flat tube 1, and expand them also in the direction orthogonal to the lengthwise direction. Meanwhile, the temperature of the side members 5 at both sides of the core 3 hardly changes to maintain the state.

SUMMARY OF INVENTION

However, in the case of the heat exchanger as shown in FIG. 7, the thermal expansion differs between the side member 5 and the flat tube 1. As a result, the stress is concentrated on the base part between the flat tube 1 and the tube plate 4, especially the base part between the flat tube and the tube plate 4 at the outermost side, resulting in the crack. Further, expansion of the flat tube 1 may cause the problem of deforming the side member 5, and deteriorating strength of the heat exchanger as a whole.

Therefore, it is an object of the present invention to improve the resistance against the thermal stress (rigidity, extensibility, and the like) of the side member 5 used for the heat exchanger.

The first aspect of the invention provides a heat exchanger in which flat tubes (1) and corrugated fins (2) are alternately arranged in parallel to constitute a core (3), both ends of each of the flat tubes (1) are inserted into and fixed to a pair of tube plates (4), side members (5) are disposed on both sides of the core (3), and both ends of each of the side members (5) in a lengthwise direction are integrally fixed to both side walls (6) of the tube plates (4) in a lengthwise direction, wherein: the side member (5) is bent and formed into a groove shape, the cross section of which has side wall parts (5*d*) and a base part (5*c*) along an entire length in the lengthwise direction of a main body part (5*a*) of the side member (5); and one or more ribs (9), which are located on both ends of the side member (5) in the lengthwise direction, are integrally and protrudingly formed at an intermediate part of the base part (5*c*) in a widthwise direction toward an outside.

The second aspect of present invention is the heat exchanger according to the first aspect, wherein the side member (5) includes the main body part (5*a*) with substantially the same length as that of the core (3), and stepped parts (5*b*) each having a tip end in the lengthwise direction formed into a stepped shape protruding toward an outside of the core (3), and the tip ends of the stepped parts (5*b*) are integrally fixed to the side walls (6) of the pair of tube plates (4); and each of the stepped parts (5*b*) of the side member (5) has one or more brace-like ribs (9) integrally and protrudingly formed toward the outside of the core (3) for connecting the main body part (5*a*) and the tip end of the stepped part (5*b*) in a slanting manner, at the intermediate part of the base part (5*c*) in the widthwise direction.

The third aspect of the present invention is the heat exchanger according to the second aspect, wherein the stepped part (5*b*) of the side member (5) includes a horizontal step surface (5*e*) in which a step surface except a part provided with the brace-like rib (9) is formed horizontally, and an outer surface of a bottom part (4*a*) of each of the pair of tube plates (4) is seated on the horizontal step surface (5*e*); and a tip end (8) of the brace-like rib (9) of the side member (5) is configured to reach at least a position of the outer surface of the bottom part (4*a*) of the tube plate (4).

The fourth aspect of present invention provides a heat exchanger in which flat tubes (1) and corrugated fins (2) are alternately arranged in parallel to constitute a core (3), both ends of each of the flat tubes (1) are inserted into and fixed to a pair of tube plates (4), side members (5) are disposed on both sides of the core (3), and both ends of each of the side members (5) in a lengthwise direction are integrally fixed to both side walls (6) of the tube plates (4) in a lengthwise direction, wherein the side member (5) is bent and formed into a groove shape, the cross section of which has side wall parts (5*d*) and a base part (5*c*) along an entire length in the lengthwise direction of a main body part (5*a*) of the side member (5).

The fifth aspect of present invention is the heat exchanger according to the fourth aspect, wherein the side member (5) includes the main body part (5*a*) with substantially the same length as that of the core (3), and stepped parts (5*b*) each having a tip end in the lengthwise direction formed into a stepped shape protruding toward an outside of the core (3), and the tip ends of the stepped parts (5*b*) are integrally fixed to the side walls (6) of the pair of tube plates (4).

The sixth aspect of the present invention is the heat exchanger according to the first to fifth aspects, including a bottomless part (10) formed by cutting the base part (5*c*) of the main body part (5*a*) of the groove-shaped side member (5) at a position substantially separated from the tube plate (4) in the lengthwise direction of the side member (5), and a stress absorbing part (11) which is formed at the position of the bottomless part (10) and in which both the side wall parts (5*d*) are bent into a wave shape and the side member (5) is easily deformable in the lengthwise direction.

In the first aspect of the present invention, the side member 5 is integrally bent and formed into a groove-like cross section along the entire length in the lengthwise direction of the side member 5. One or more ribs 9 are integrally formed toward the outside at an intermediate part of the base part 5*c* in the widthwise direction at both ends of the side member 5 in the lengthwise direction. This may improve rigidity at both ends of the side member 5. It is possible to provide the highly reliable heat exchanger that ensures to prevent cracking at the root of the flat tube adjacent to the side member 5 in spite of the stress owing to the core swelling toward both sides in planar direction during operation of the heat exchanger.

In the second aspect of the invention, one or more brace-like ribs 9 serve to connect the main body part 5*a* and the tip end of the stepped part 5*b* of the side member 5 in a slanting manner. The brace-like rib 9 at the stepped part 5*b* of the side member further ensures to effectively bear the stress exerted to the side member, thus preventing deformation of the side member. This may prevent strain and crack in the base part of the flat tube 1 adjacent to the stepped part 5*b*, thus improving reliability of the heat exchanger.

The invention according to the third aspect is configured to allow the stepped part 5*b* of the side member 5 to have a horizontal step surface 5*e*, and the outer surface of the bottom part 4*a* of the tube plate 4 to be seated on the horizontal step surface 5*e*. This makes it possible to bear the stress further effectively, thus preventing deformation of the stepped part 5*b* of the side member.

Further, the invention according to the fourth and fifth aspects is constituted by removing the structure of the rib 9 of the first or second aspects. The side member 5 in this case reliably prevents the crack in the root of the flat tube adjacent to the side member 5, resulting in the highly reliable heat exchanger.

The invention according to the sixth aspect includes a bottomless part 10 formed by cutting the base part 5*c* of the main body part 5*a* of the groove-shaped side member 5 at a position substantially separated from the tube plate 4 in the lengthwise direction of the side member 5, and a stress absorbing part 11 which is formed at the position of the bottomless part 10 and in which both the side wall parts 5*d* are bent into a wave shape and the side member 5 is easily deformable in the lengthwise direction. It is therefore possible to effectively absorb the stress exerted to the side member 5 in the extending direction.

DETAILED DESCRIPTION OF THE INVENTION

Subsequently, embodiments according to the present invention will be described with reference to the drawings.

Figure 1:
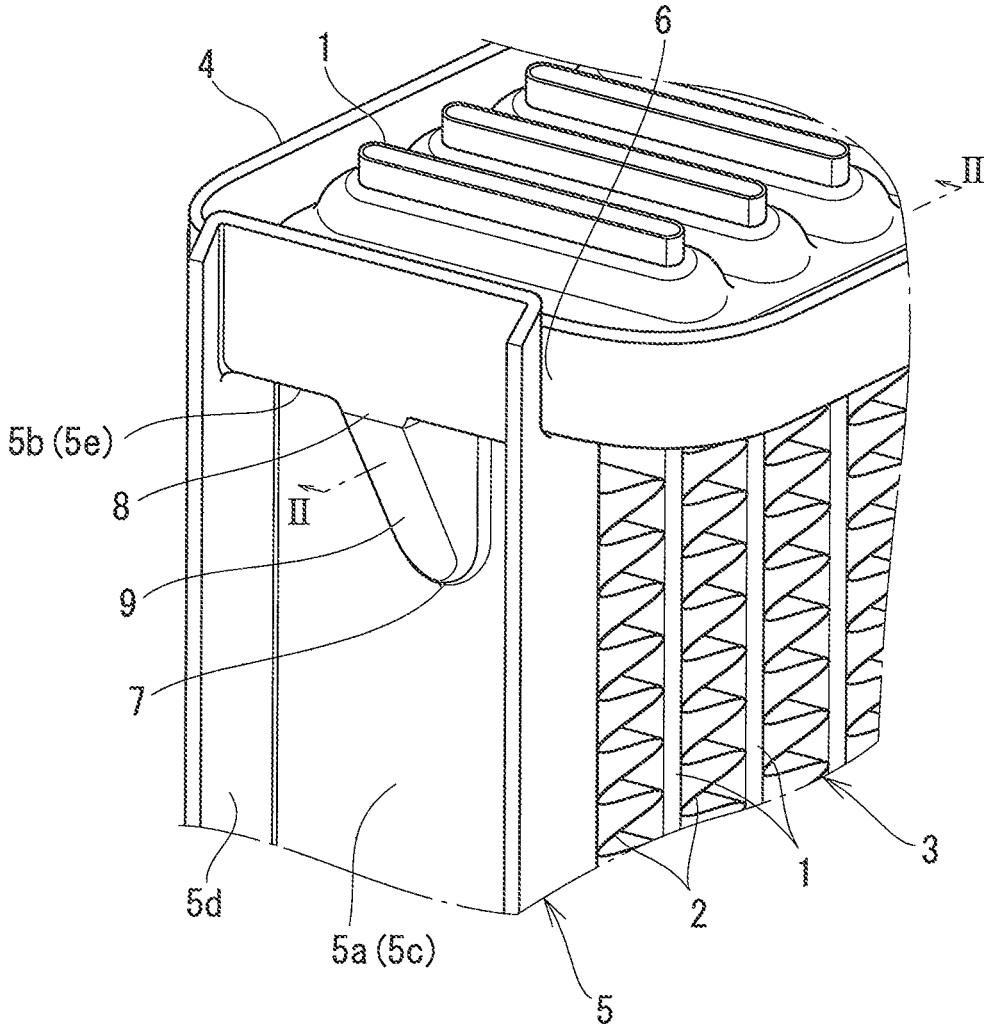
FIG. 1 is a perspective view of an essential part of a side member 5 of a heat exchanger of a first embodiment of the present invention.
Figure 2:
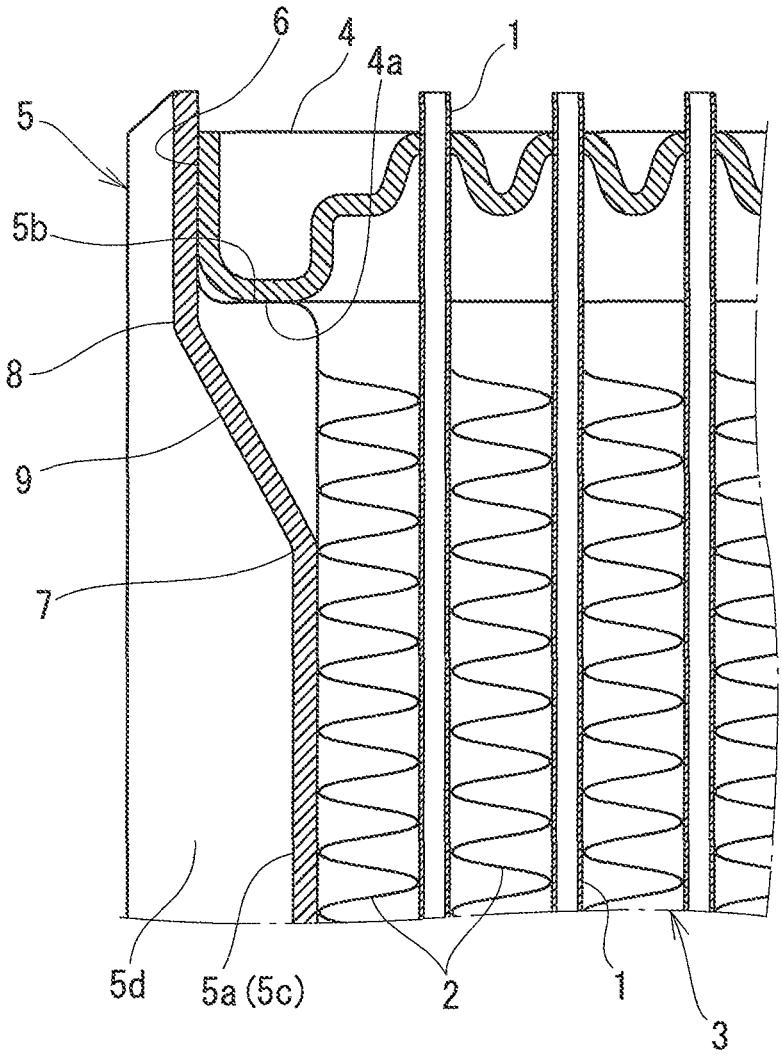
FIG. 2 is a longitudinal sectional view of the essential part of the side member 5.

FIGS. 1 and 2 represent a first embodiment.

First Embodiment

The heat exchanger of the present invention is configured such that corrugated fins 2 and flat tubes 1 form a core 3, both ends of each of the flat tubes 1 are inserted into tube insertion holes of tube plates 4, and side members 5 are disposed at both ends of the core. The present invention is characterized by the portion where the side member 5 is joined with the core 3 and the tube plate 4.

In this example, as shown in FIG. 1, the side member 5 has a pair of side walls 5*d* bent and formed along the entire length of a base part 5*c* in the lengthwise direction with its cross section formed into a groove shape.

Stepped parts 5*b* each formed into a stepped shape with its tip end protruding to an outside of the core 3 are provided at both ends of the side member 5 in the lengthwise direction. Brace-like ribs 9 are integrally and protrudingly provided at the center of the stepped part 5*b* in the widthwise direction toward the outside of the core 3. The stepped part 5*b* is formed at a position corresponding to the vicinity of the base part between the tube plate 4 and the flat tube 1 which will be described later.

The rib 9 is formed thin and long at the center of the side member 5 in the widthwise direction, connecting a root 7 of the stepped part 5*b* (in this example, the base part 5*c* of the main body part 5*a* of the side member 5) and a tip end 8 in a slanted bracing manner. Except the part where the brace-like rib 9 is formed, the stepped part 5*b* has a horizontal step surface 5*e*.

Subsequently, the tube plate 4 with a dish-like shape includes an annular side wall 6 with a rising rim. A bottom part 4*a* of the tube plate 4 has a large number of insertion holes in parallel with one another through which the flat tubes 1 are inserted. The circumferential rim part of the bottom part 4*a* has an annular groove with which a sealing material is fit.

In this example, as shown in FIG. 2, the outer surface of the side wall 6 of the tube plate 4 and the tip end of the stepped part 5*b* of the side member 5 are joined. The step surface 5*e* of the stepped part 5*b* and the outer surface of the bottom part 4*a* of the tube plate 4 are joined. As a result, rigidity of the side member 5 is improved sufficient to bear the stress exerted thereto.

Further, in the example of FIGS. 1 and 2, one end of the brace-like rib 9 provided at the side member 5 is positioned at the root 7 of the stepped part, and the other end reaches a position of the outer surface of the bottom part 4*a* of the tube plate 4. Therefore, the intermediate part of the stepped part 5*b* of the side member 5 in the widthwise direction has no step surface 5*e* for formation of the rib 9.

As FIG. 1 shows, in the heat exchanger having such a side member 5, the flat tubes 1 through each of which the cooling object circulates therein and the corrugated fins 2 are alternately arranged in parallel with one another, and both ends of each of the flat tubes 1 are inserted to pierce through the tube plate 4 to form the core 3. The side members 5 are disposed at both ends (the view at the right side is omitted) of the corrugated fins 2 in the parallel arrangement direction. Each of those components is made of aluminum material (including aluminum alloy). Those components will be fixed to each other in the high-temperature furnace through brazing.

A resin tank with a not shown inlet/outlet pipe for the cooling object is fit with the tube plate 4 via the sealing material to complete production of the heat exchanger.

Besides the resin material, the aluminum material may be used for forming the tank. In this case, the tank and the tube plate 4 are integrally mounted through brazing or welding.

In the embodiment of FIGS. 1 and 2, upon circulation of the high-temperature cooling object inside the heat exchanger, the stress is concentrated in the base part between the flat tube and the tube plate 4 at the outermost position of the core 3.

The side member 5 has the stepped parts 5*b* formed at both ends thereof in the lengthwise direction, and a pair of side walls 5*d* are bent and formed along the entire length in the lengthwise direction while including the stepped parts 5*b*. The brace-like rib 9 is further disposed on the stepped part 5*b*, which imparts the strength sufficient to bear the stress concentrated in the specific part of the heat exchanger. This ensures to prevent crack and deformation of the flat tube, and avoid the risk of leakage of the cooling object.

In this example, only one brace-like rib 9 is provided. However, it is possible to provide a plurality of ribs 9.

Other Examples Relating to Shape of Rib 9 of Side Member 5

Figure 3A:
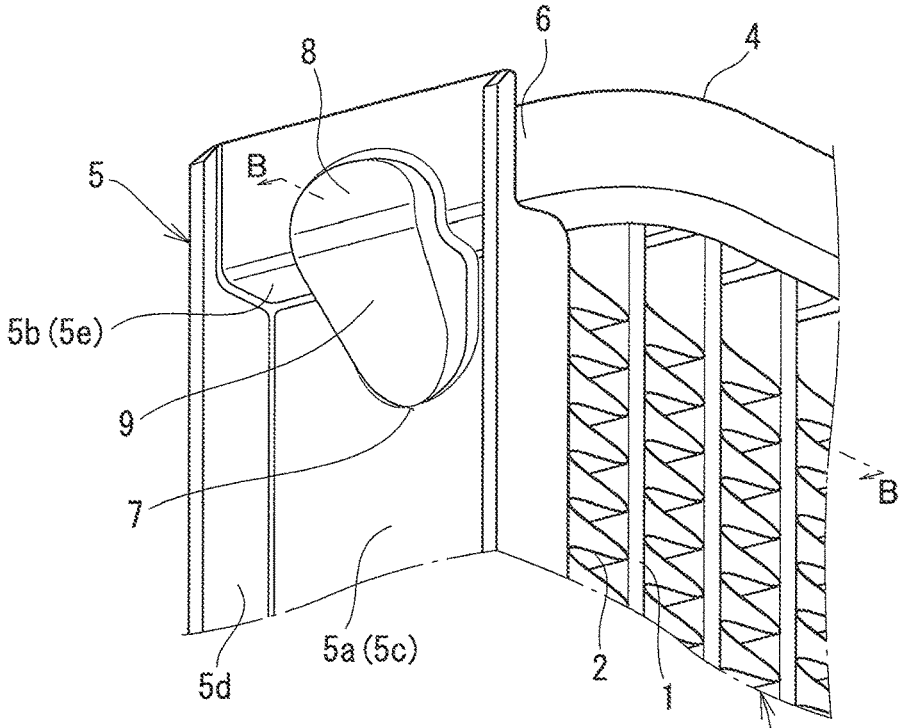
FIG. 3(A) is a perspective view of an essential part of a side member 5 of a heat exchanger of another example of the present invention.
Figure 3B:
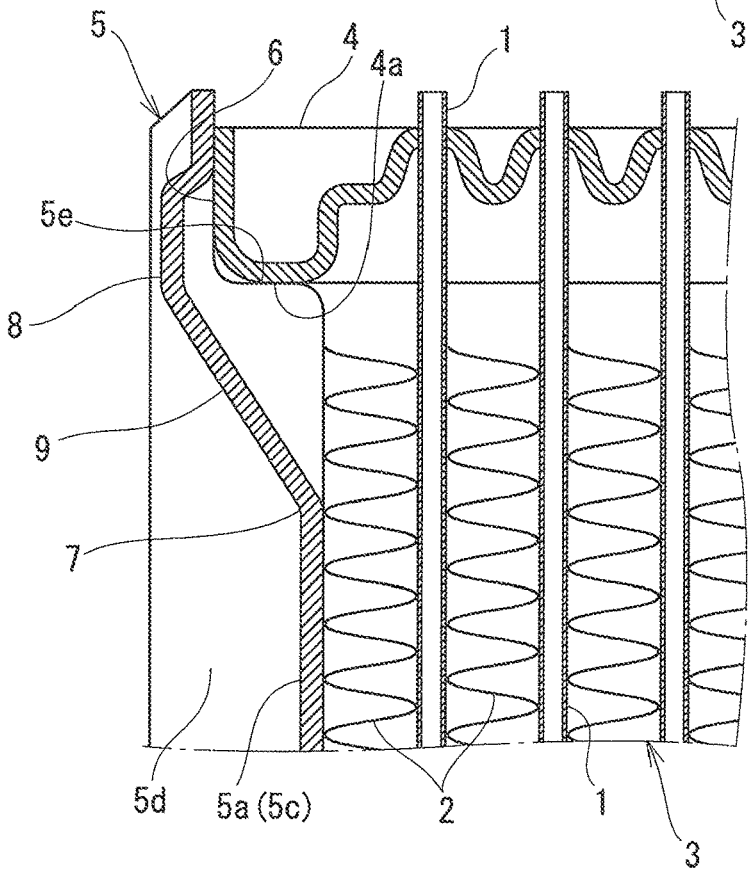
FIG. 3(B) is a longitudinal sectional view of the essential part of the side member 5.
Figure 4A:
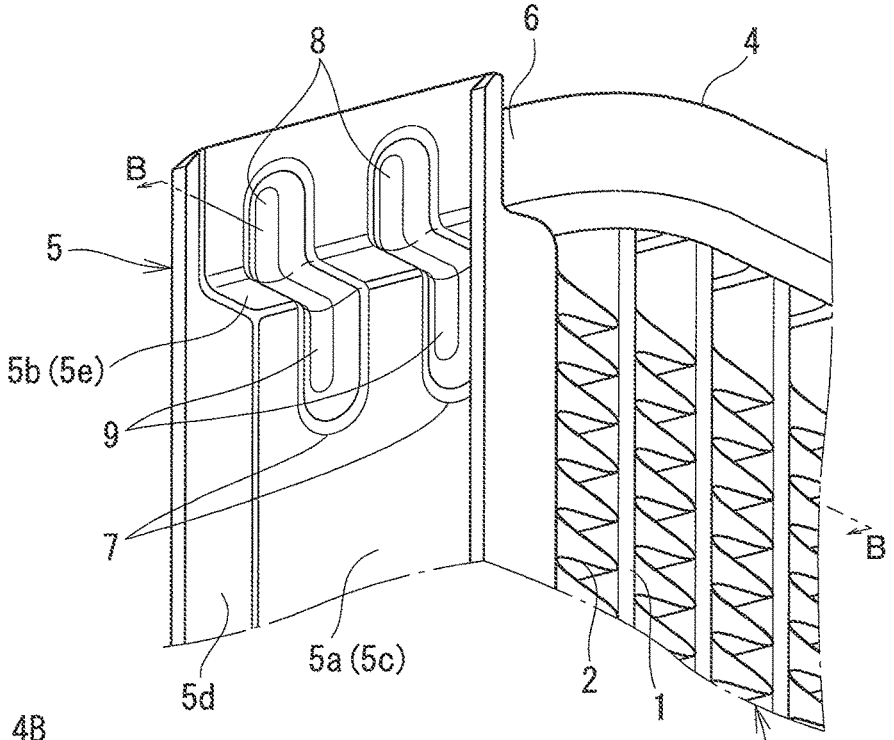
FIG. 4(A) is a perspective view of an essential part of a side member 5 of a heat exchanger of still another example of the present invention.
Figure 4B:
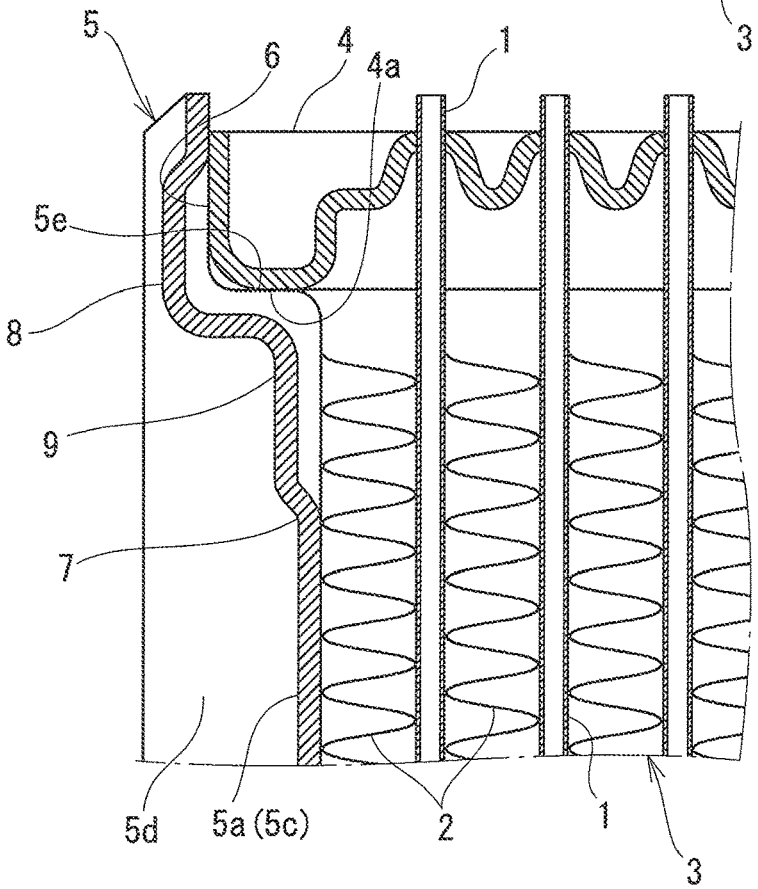
FIG. 4(B) is a longitudinal sectional view of the essential part of the side member 5.

FIGS. 3 and 4 are views showing modified examples of the shape of the rib 9 disposed on the side member 5. The function effects are the same as those of the rib 9 of the first embodiment.

In the example of FIG. 3, the brace-like rib 9 is formed wide at the center of the side member 5 in the widthwise direction, connecting the root 7 of the stepped part 5*b* (in this example, the base part 5*c* of the main body part 5*a* of the side member 5) and the side wall 6 of the tube plate 4 in the slanted bracing manner. The use of the wide and long brace-like rib 9 may improve the strength at the area with the rib for further improving the bearing force against the stress.

FIG. 4 shows still another example which is substantially the same as the first embodiment in FIG. 1 except that two generally employed ribs 9 are used and disposed in parallel with each other in place of the brace-like rib 9.

The shape of the rib 9 of the side member 5, and the number of the ribs 9 described in the first embodiment and other examples have been disclosed as mere examples. It may be arbitrarily designed so long as the resultant function effects do not deviate from those derived from the scope of the claims of the present application.

Second Embodiment

Figure 5:
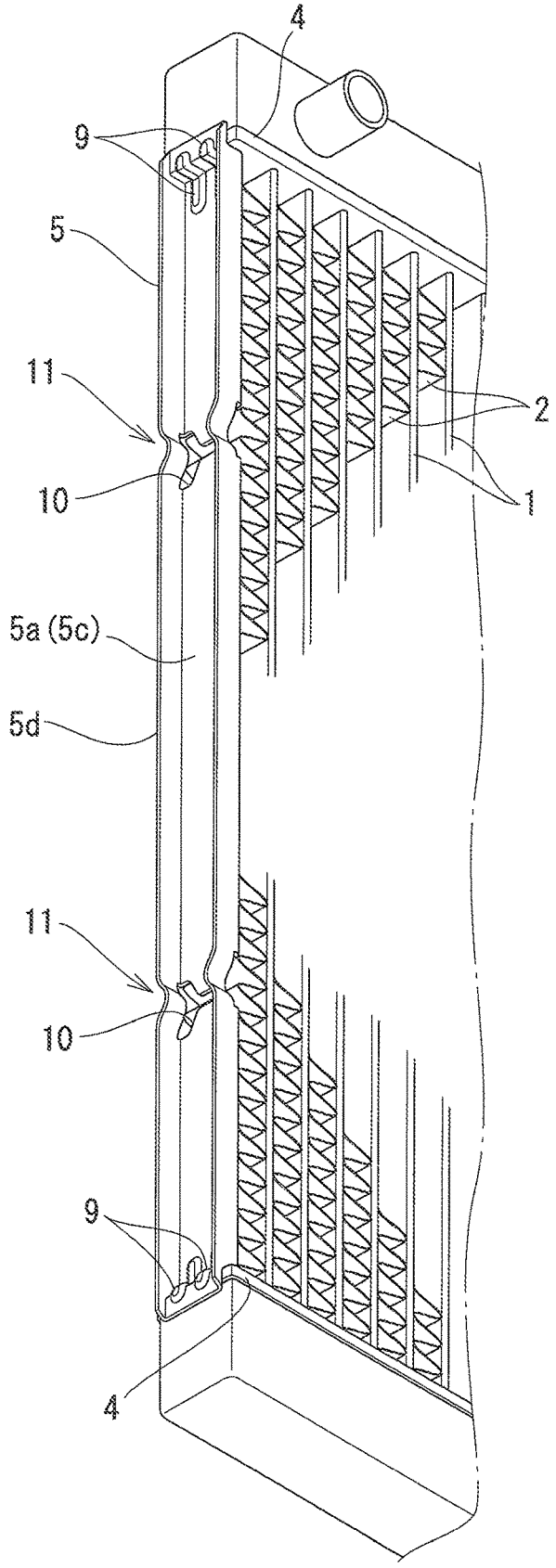
FIG. 5 is a perspective view of an essential part of a side member 5 of a heat exchanger of a second embodiment of the present invention, indicating a stress absorbing part 11 provided in the side member 5.

FIG. 5 shows still another embodiment of the present invention, having a stress absorbing part 11, as an example, for absorbing the stress exerted to the side member 5 provided with the rib 9 in the expansion direction.

The side member 5 has the rib 9 with structure in FIG. 4 described above, and the bottomless part 10 formed by cutting the base part 5*c* into the H-like shape at a position substantially separated from the tube plate 4. Further, the side wall parts 5*d* are curved in a wave shape at the position of the bottomless part 10 to form the stress absorbing part 11. The stress absorbing part 11 serves to easily deform the side member 5 in response to expansion of the core 3 in the lengthwise direction of the flat tube 1 in operation of the heat exchanger. Pairs of the bottomless part 10 and the stress absorbing part 11 are formed substantially equally apart from the pair of the upper and the lower tube plates 4, respectively. Similarly, the structure applies also to the not shown side member 5 at the right side.

Subsequently, an example of the method of molding the stress absorbing part 11 will be described. First, the H-like slit is cut through the press molding process across the entire width of the base part 5*c* of the side member 5 to form the bottomless part 10. In the above-described process, the H-like upper and lower flanges are disposed along the side wall part 5*d* so that the side member 5 at the position of the bottomless part 10 is easily deformed under the external force in the widthwise direction. Both side wall parts 5*d* are press molded in the widthwise direction at the position of the side member 5 so that the resultant waveforms face with each other.

In the example as described above, upon circulation of the high-temperature cooling object inside the heat exchanger, the core 3 thermally expands in the lengthwise direction of the flat tube 1 and the direction orthogonal thereto. The thermal expansion of the flat tube 1 in the lengthwise direction is absorbed by the stress absorbing part 11 of the side member 5. Under the load of the side member 5 owing to the thermal expansion of the core 3 in the widthwise direction, the stress absorbing part 11 has its modulus of section increased, thus preventing deformation.

Further, the base between the side member 5 and the tube plate 4 is provided with the stepped part 5*b*, the rib 9, and the side wall 5*d* including those members along the entire length of the side member 5 so as to prevent deformation of especially the base of the side member 5. This makes it possible to prevent deformation of the base of the flat tube 1 at the outermost end of the core 3, and the associated crack in the base of the flat tube.

Third Embodiment

Figure 6A:
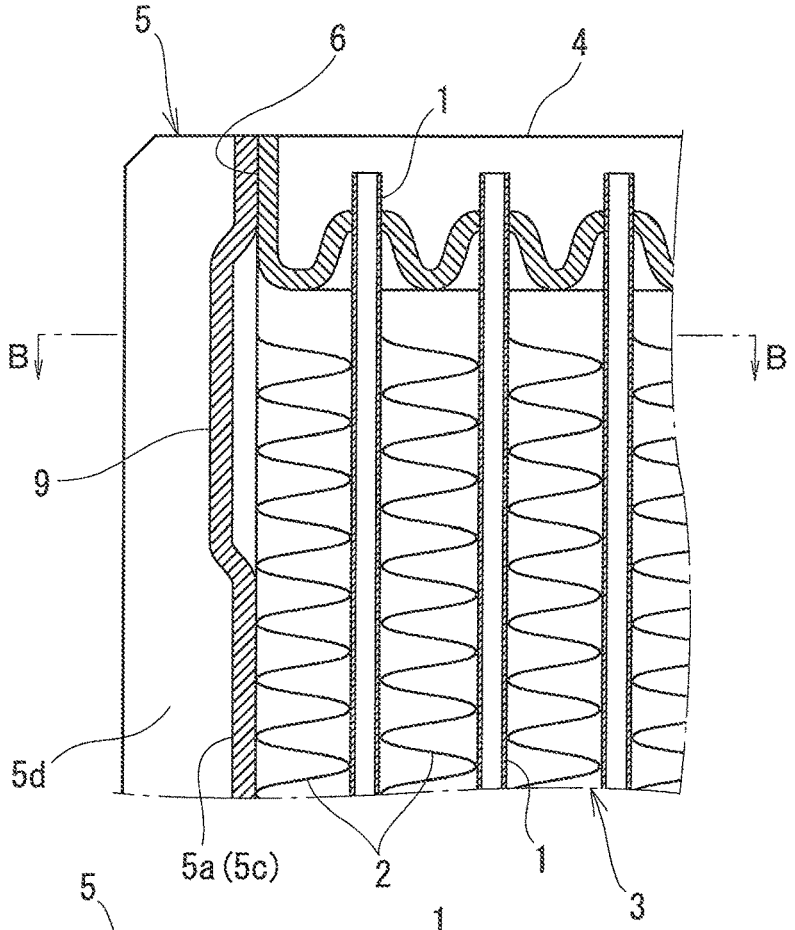
FIG. 6(A) is a longitudinal sectional view of an essential part of a side member 5 of a heat exchanger of a third embodiment of the present invention.
Figure 6B:
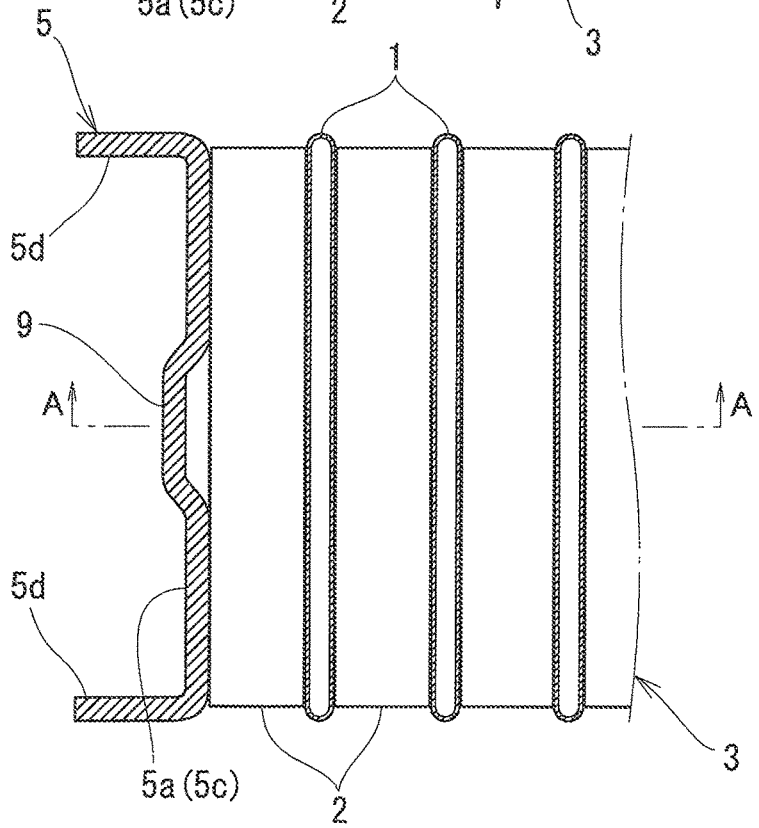
FIG. 6(B) is a transverse sectional view of the essential part of the side member 5.
Figure 7:
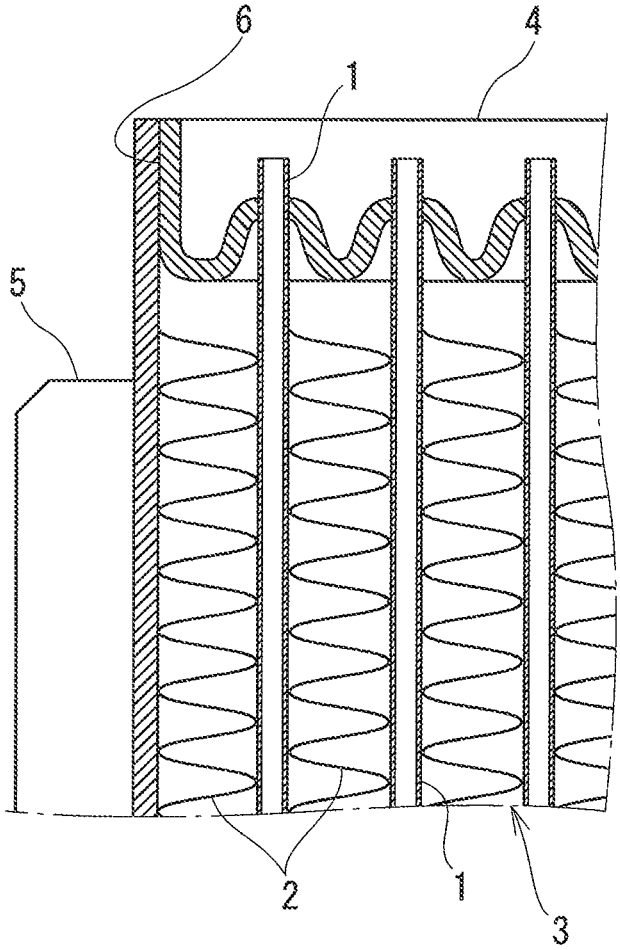
Fig. 7 PRIOR ART
FIG. 7 is a longitudinal sectional view of an essential part of a conventional heat exchanger.

FIG. 6 shows still another embodiment of the present invention in which the side member 5 does not have the stepped part 5*b*, and is bent and formed into the groove-like cross section along the entire length of the main body part 5*a* in the lengthwise direction. The ribs 9 each having a convex shape are protrudingly formed toward the outside of the core 3 at both ends of the side member 5 in the lengthwise direction.

Note that the first embodiment shows the example that the step surface 5*e* of the stepped part 5*b* of the side member 5 is joined with the outer surface of the bottom part 4*a* of the tube plate 4. It may be configured not to join the step surface 5*e* and the bottom part 4*a* while having a gap therebetween.

The invention claimed is:

1. A heat exchanger comprising: flat tubes and corrugated fins alternately arranged in parallel to constitute a core, wherein respective ends of each of the flat tubes are inserted into and fixed to respective tube plates, the heat exchanger further comprising two side members disposed on opposite sides of the core, wherein respective ends of the side members in a longitudinal direction of the side members are integrally fixed to respective side walls of the tube plates, and wherein:

each of the side members is bent and formed into a groove shape, the cross section of which has opposing side wall parts and a base part, wherein the base part contacts corrugated fins adjacent to the base part, and wherein the groove shape extends along a length extending from the side wall of one of the tube plates to the side wall of an opposing of the tube plates;

the heat exchanger further comprising one or more ribs located on respective end portions of the side members in the longitudinal direction of the side members, wherein the one or more ribs are integrally and protrudingly formed at intermediate portions of the base parts in a widthwise direction and wherein the one or more ribs protrude in a direction away from the heat exchanger core, and wherein the base parts have substantially a same length as that of the core, and comprise stepped parts at the end portions of the side members, each stepped part having a tip end, wherein each of the stepped parts is formed into a stepped shape protruding toward an outside of the core, and the tip ends of the stepped parts are integrally fixed to respective side walls of the tube plates; and the one or more ribs are configured to connect the base parts of the side members and the tip ends of the stepped parts by extending at least from the base parts of the side members to the tip ends of the stepped parts, wherein the one or more ribs have slanting outer surfaces extending from the base parts to the tip ends of the stepped parts.

2. The heat exchanger according to claim 1, wherein:

the stepped parts of the side members include flat step surfaces, and wherein an outer surface of each of the tube plates is seated on a respective of the flat step surfaces; and a tip end of each of the one or more ribs of the side members is configured to reach at least a position proximate the outer surface of a side wall of one of the tube plates.

3. A heat exchanger comprising: flat tubes and corrugated fins alternately arranged in parallel to constitute a core, wherein respective ends of each of the flat tubes are inserted into and fixed to respective tube plates, the heat exchanger further comprising two side members disposed on opposite sides of the core, wherein respective ends of the side members in a longitudinal direction of the side members are integrally fixed to respective side walls of the tube plates, and wherein:

each of the side members is bent and formed into a groove shape, the cross section of which has opposing side wall parts and a base part, wherein the base part contacts corrugated fins adjacent to the base part, and wherein the groove shape extends along a length extending from the side wall of one of the tube plates to the side wall of an opposing of the tube plates;

the heat exchanger further comprising one or more ribs located on respective end portions of the side members in the longitudinal direction of the side members, wherein the one or more ribs are integrally and protrudingly formed at intermediate portions of the base parts in a widthwise direction and wherein the one or more ribs protrude in a direction away from the heat exchanger core, and wherein the base parts have substantially a same length as that of the core, and comprise stepped parts at the end portions of the side members, each stepped part having a tip end, wherein each of the stepped parts is formed into a stepped shape protruding toward an outside of the core, and the tip ends of the stepped parts are integrally fixed to respective side walls of the tube plates; and the one or more ribs are configured to connect the base parts of the side members and the tip ends of the stepped parts by extending at least from the base parts of the side members to the tip ends of the stepped parts.

4. A heat exchanger comprising: flat tubes and corrugated fins alternately arranged in parallel to constitute a core, wherein respective ends of each of the flat tubes are inserted into and fixed to respective tube plates, the heat exchanger further comprising two side members disposed on opposite sides of the core, wherein respective ends of the side members in a longitudinal direction of the side members are integrally fixed to respective side walls of the tube plates, and wherein:

each of the side members is bent and formed into a groove shape, the cross section of which has opposing side wall parts and a base part, wherein the base part contacts corrugated fins adjacent to the base part, and wherein the groove shape extends along a length extending from the side wall of one of the tube plates to the side wall of an opposing of the tube plates;

the heat exchanger further comprising one or more ribs located on respective end portions of the side members in the longitudinal direction of the side members, wherein the one or more ribs are integrally and protrudingly formed at intermediate portions of the base parts in a widthwise direction and wherein the one or more ribs protrude in a direction away from the heat exchanger core, and wherein the base parts have substantially a same length as that of the core, and comprise stepped parts at the end portions of the side members, each stepped part having a tip end, wherein each of the stepped parts is formed into a stepped shape protruding toward an outside of the core, and the tip ends of the stepped parts are integrally fixed to respective side walls of the tube plates; and the stepped parts include side surfaces which face away from the core of the heat exchanger and the ribs are configured to connect the base parts of the side members to the side surfaces of the stepped parts by extending from the base parts to the tip ends and to the side surfaces, respectively.

5. The heat exchanger of claim 4, wherein the one or more ribs extend over the tip ends and comprise stepped shapes protruding toward an outside of the core.

6. The heat exchanger of claim 4, wherein at least one of the side members comprises two of the ribs.

7. The heat exchanger according to claim 4, wherein the one or more ribs extend substantially across the side surfaces.

* * * * *